US005178917A

United States Patent [19]

Tenney et al.

[11] Patent Number: 5,178,917

[45] Date of Patent: Jan. 12, 1993

[54] METHOD FOR DELIVERY OF FIRE RETARDANT

[75] Inventors: Diane Tenney; Michael Dosdourian, both of Whittier, Calif.

[73] Assignee: Tri-Spray Systems Corporation, Whittier, Calif.

[21] Appl. No.: 865,976

[22] Filed: Apr. 9, 1992

Related U.S. Application Data

[62] Division of Ser. No. 671,018, Mar. 18, 1991.

[51] Int. Cl.[5] ..... B05D 5/00

[52] U.S. Cl. ..... 427/393.3; 156/62.8; 156/550

[58] Field of Search ..... 427/381, 393.3, 394; 118/315, 325; 156/62.8, 550, 551

[56] References Cited

U.S. PATENT DOCUMENTS 4,185,135 1/1980 Huff ..... 427/393.3

5,102,701 4/1992 Davis et al. ..... 427/393.3

*Primary Examiner*—W. Gary Jones

*Assistant Examiner*—Charles K. Friedman

*Attorney, Agent, or Firm*—Wagner & Middlebrook

[57] ABSTRACT

A delivery system for delivering liquid fire retardant material to cotton batting during the course of producing the cotton batting includes a spray manifold arrangement including a liquid conduit carrying the fire retardant material under pressure, a parallel air manifold carrying air under pressure and a plurality of spaced nozzles distributed across the manifold, each of which is connected to both conduits. This manifold is physically positioned in the cotton batt producing machines just downstream of the garnetting rollers where two separate thin webs of cotton are produced. These webs are impacted by spray from the nozzles just ahead of and at the point where the webs are combined. A tank containing the fire retardant material is connected to a regulated source of air under pressure some of which is supplied to put the contents of the tank under pressure such that it flows to the liquid conduit and some of which is supplied to the air manifold.

9 Claims, 2 Drawing Sheets

METHOD FOR DELIVERY OF FIRE RETARDANT

This is a divisional of copending application Ser. No. 07/671,018 filed on Mar. 18, 1991.

BACKGROUND OF THE INVENTION

This invention relates to a system and process for applying or delivering liquid fire retardant material to cotton batts, cotton insulation and the like during course of the production.

The production of cotton batts is an old and well known process using machinery which in general has long been in the public domain. At least several hundred companies throughout the United States produce cotton batts for use in making furniture or mattresses, or for insulation, or for other purposes. For the most part, the basic processes are essentially the same, as described below, although some installations may vary such as to the nature and type of equipment for dust abatement, or conveyors etc. The basic production machinery includes a picker which receives chunks or slabs of compressed raw cotton manually pulled from the bale and put on a feed table feeding the picker. The picker includes a large roller having a number of long spikes which tear the slabs of cotton into smaller pieces. A fine mist of light oil is typically added at this point. These pieces are then transferred to a large housing or hopper containing a conveyor which includes smaller spikes and which further blends and fluffs up the cotton. From this hopper/conveyor called a willow, the cotton is sent to a garnetting machine which includes a significant number of rollers having external spikes and which break the cotton down into finer segments and segregate it into two thin wide webs which are delivered from the last rolls in the garnetting machine called comber rolls. These webs which may be as thin as 1/16 to ½ inch are then combined by being conveyed together to provide a double thickness and this double thick layer is then supplied to a lapper conveyor which doubles the layers back and forth, thereby stacking the layers to form a web of the desired thickness. This web is then run through a feed conveyor to a roller to compress the batts as desired before they are cut to desired lengths.

Such cotton batts are, of course, very flammable and there are various requirements that they be treated with some form of fire retardant material. For many years the standard method of making the cotton batts fire retardant has been to apply a fine spray of very light oil to the cotton, usually at the picker. Boric acid powder is then shaken on the cotton web, usually upstream of the lapper conveyor. The fine oil serves both as a dust abatement measure and as a means to cause the boric acid powder to stick to the cotton. This process, although effective, leaves much to be desired because of the need to supply substantial quantities of the oil and boric acid powder; because the boric acid powder tends to create a dust problem despite the use of the oil; and because the boric acid powder is somewhat hazardous to the workers nearby, both because of adverse effects from breathing it and because it becomes very slippery underfoot. It has also been found that the boric acid powder tends to shake out of the cotton batt material after an extended period of time.

Applicants have been aware of the availability of fire retardant materials in liquid form which have been usefully employed in a number of applications where porous or cellulose-type materials are involved. In particular, it has been found to be useful for retarding the spreading of fire in natural fiber materials such as straw, paper and various forms of wood such as plywood, wood shakes or framing lumber. One such liquid fire retardant material is marketed by Nochar, 8101 Crawfordville Road, Indianapolis, Indiana 46253. This material is non-toxic and bio-degradable, absorbs into the fibers of the above listed natural fiber materials and does not dry out or separate from the protected material.

In contacting several cotton batting manufacturers, applicants were made aware of the process and equipment described above and the several disadvantages inherent in the application of boric acid powder to the cotton. Testing by applicants of the liquid fire retardant material on the cotton batting demonstrated that the retardant material was effective to reduce the flammability of the cotton material to the level required by the State of California Department of Consumer Affairs Technical Bulletins Nos. 116 and 117. One test specified by this document, which must be complied o with to sell cotton batting in furniture or mattresses in California, is that a lighted cigarette placed on the cotton batting material, must not burn or char the cotton more than an inch around the cigarette in any direction. Applicants found that there was no known system for applying a liquid fire retardant material such as that described above to the cotton batting material.

BRIEF DESCRIPTION OF THE INVENTION

Applicants initially devised a manifold structure which was dimensioned to reach across the width of the conveyors used in the above process, the manifold structure including an air conduit, a liquid conduit and a series of spray nozzles connected to the air and liquid conduits for distributing a spray of liquid fire retardant material across the web of cotton moving along the conveyors. A tank connected to an available supply of air under pressure was filled with the liquid fire retardant material and supplied with air under pressure to force the liquid to flow to the liquid conduit part of the manifold structure. The air source, regulated to the desired pressure was supplied to the air conduit part of the manifold.

The manifold was first connected to direct spray at the cotton in the picker. To get adequate penetration, the cotton was made excessively wet which interfered with subsequent processing. It was then attempted to locate the spray manifold downstream of the point where the thin webs from the garnetting machine were combined. Despite a substantial amount of experimentation with air and liquid pressure levels, the penetration proved inadequate to provide an acceptable level of fire retardancy.

Applicants then placed the air and liquid spray manifold just downstream of the final garnetting rollers or combers and directed the spray at the thin webs from these rollers just ahead of and at the point of combining the thin webs. After a certain amount of experimentation with liquid and air pressure levels and with some different types of spray heads, a system and process was perfected which provided excellent fire retardant qualities in the cotton, did not excessively wet the cotton, and which resulted in a substantial reduction in the overall amount of fire retardant material used.

BRIEF DESCRIPTION OF THE DRAWING

This invention may be more clearly understood from the following detailed description and by reference to the drawing in which.

DETAILED DESCRIPTION OF THE INVENTION

Figures 1, 2:
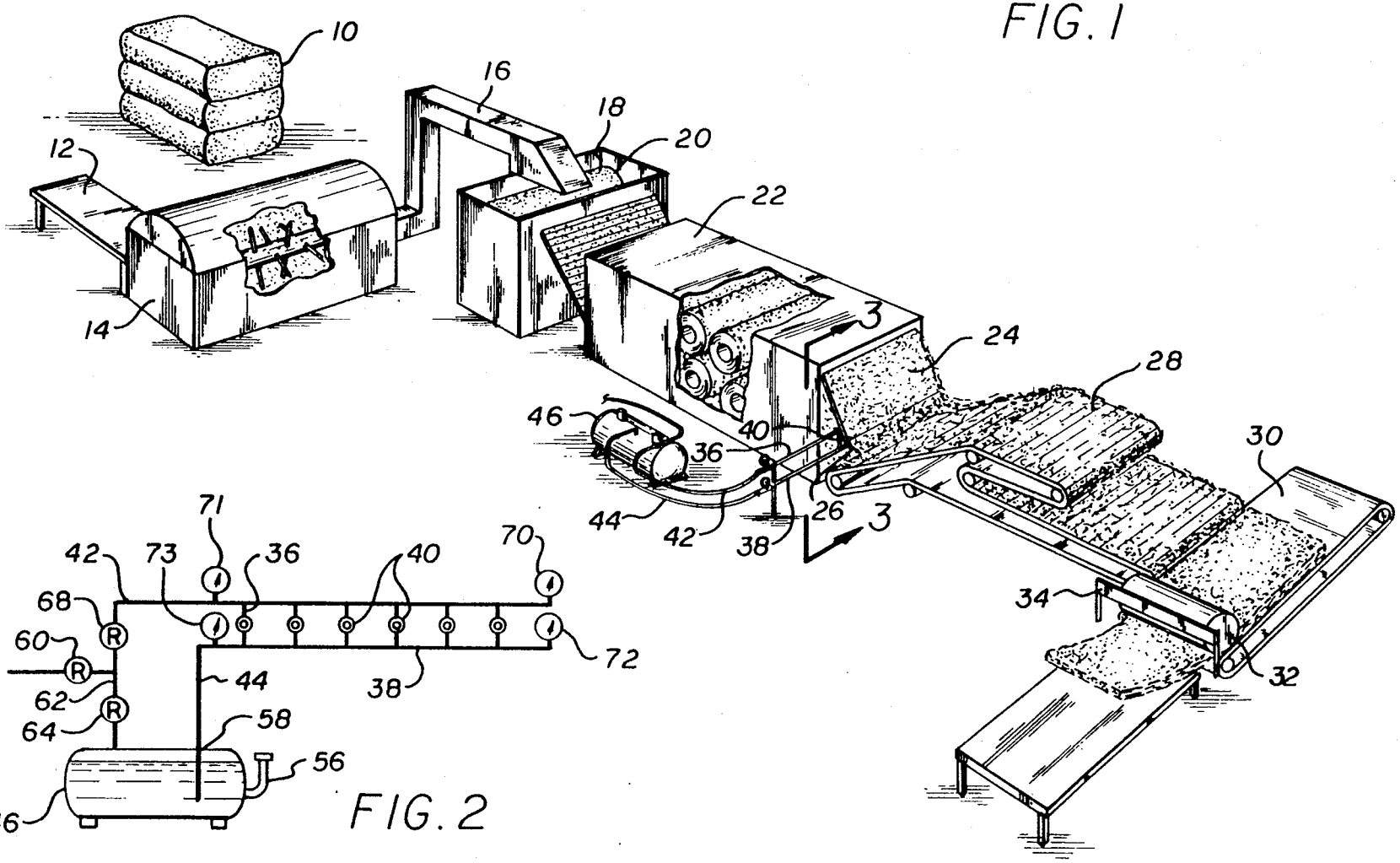
FIG. 1 is a schematic drawing of a production line for manufacturing cotton batting material with our fire retardant delivery system installed.
FIG. 2 is a schematic diagram of the air and liquid manifold system used in the fire retardant delivery system of FIG. 1.

Referring now to FIG. 1, a somewhat simplified schematic drawing of a production line for manufacturing cotton batting material is shown. The compressed cotton pulled in clumps from the bale 10 is manually placed on a feed table 12 which delivers it to a large container 14 called a picker which has a rounded top and which carries internally a rotating shaft having a substantial number of long spikes. This is the point where a fine mist of light oil was added in the prior art process and this step may be retained as a dust abatement measure if other dust abatement equipment is not adequate or present. The clumps of cotton are reduced in size substantially in the picker and are then supplied through a conveyor 16 to a large hopper 18 called a willow. In this hopper is an endless belt conveyor 20 which carries a large number of spikes, finer then those of the picker, which further break the cotton apart and fluff it up.

The cotton is then conveyed to a garnetting machine 22 consisting of a large number of rollers each having relatively short spikes on its surface. Passing through the garnetting machine 22, the cotton is broken into much finer fragments and leaves the last pair of rollers, called the comber rollers, in the form of a pair of upper and lower thin webs of cotton 24 and 26, respectively, which may be approximately 1/16 to ½ inch thick. From the garnetting machine, the upper and lower webs 24,26 are combined in a lapper conveyor 28 which folds the combined webs over and over to arrive at the desired batt thickness. The batts at the desired thickness are then supplied to a feed conveyor 30, to a roller 32 which compresses the batt somewhat and to a cutter 34 which cuts the batts to the desired length.

Located just upstream of the location where the separate webs 24,26 from the garnetting machine are combined such that it is physically positioned between the webs, is a manifold structure including an air conduit 36 and a liquid conduit 38 with a plurality (normally 6) of spray nozzles 40 distributed across the manifold, each of which is connected to the air and liquid conduits. Depending upon the width of the webs, the number of spray nozzles may vary. We have found a spacing of ten inches to be suitable for the application described herein. Each of the air and liquid conduits is connected to a suitable air and liquid hose, numerals 42 and 44 respectively, which are connected to pressure regulating means located on the top of a tank 46 containing liquid fire retardant material and air under pressure. Liquid conduit 38 and associated pipes and spray nozzles are preferably formed of stainless steel since the liquid fire retardant material is slightly corrosive to some metals. Because of the tendency of bits of cotton to adhere to the conduits 36 and 38 and to build up on the nozzles, it is useful, though not absolutely required, to shield conduits 36 and 38 and adjacent nozzle parts with polytetrafluroethylene material (Teflon).

FIG. 2 is a schematic diagram of the air and liquid manifold system used in our fire retardant delivery system. Shown in this view is the tank 46 which includes a fill pipe 56 through which the liquid fire retardant material is supplied. A liquid outlet pipe 58 is threaded into the tank and includes an internal delivery pipe reaching substantially to the bottom of the tank 46. Air under substantial pressure is supplied to a filter 60 and a regulator 64 carried on the tank which regulates the pressure to a level compatible with the system, such as 15 psi. The filtering function is necessary because many industrial air supply systems also supply undesirable amounts of oil, dirt or lint which would tend to clog the nozzles. Air from the filter 60 is connected through a pipe 62 to a regulator 64 on the tank which permits air under regulated pressure to enter the tank and thereby place its contents under sufficient pressure that the fire retardant material will flow readily through hose 44 to liquid conduit 38. The pressure in liquid conduit 38 is regulated by means of a pressure regulator 64.

Air from the filter 60 is also supplied through hose 42 to air conduit 36 where its pressure is regulated by means of a pressure regulator 68. Suitable pressure gauges 70, 71, 72 and 73 are preferably connected to air and liquid conduits 36 and 38 respectively.

Applicants have found that with the air pressure in the air conduit 36 at 16 psig and the liquid pressure in conduit 38 maintained at 5 psig, our fire retardant delivery system will spray 1.4 gallons of fire retardant per hour on 350 lbs. of cotton batt material delivered through the described production system.

Figure 3:
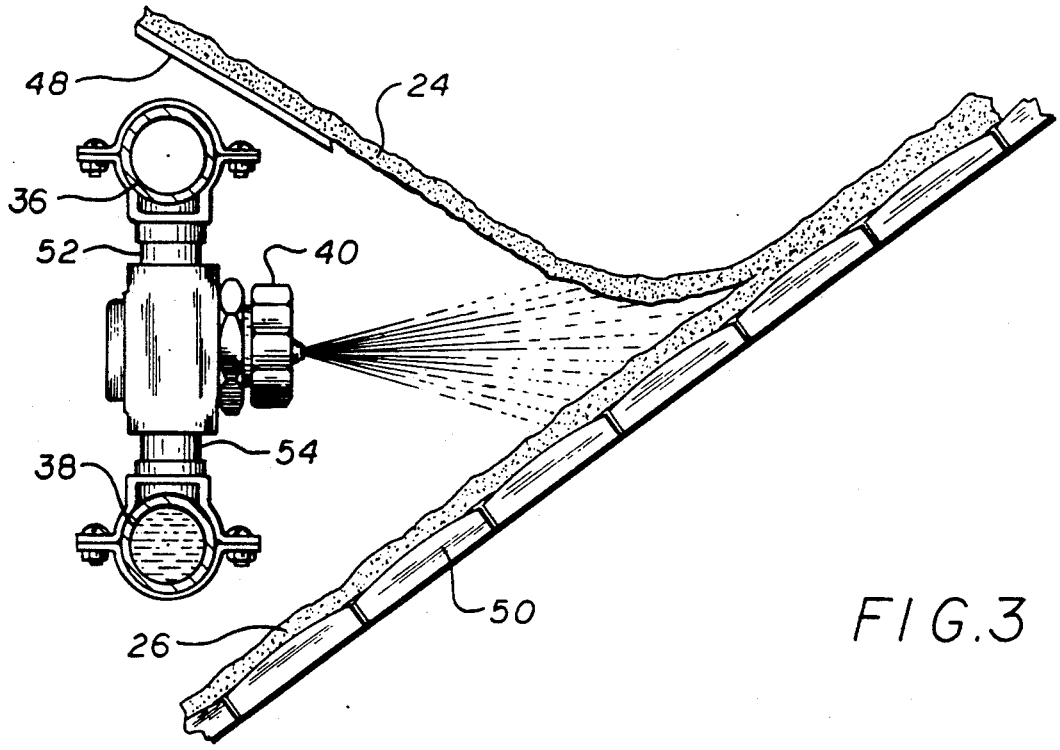
FIG. 3 is an enlarged view of a portion of the production line showing our fire retardant delivery system installed.

FIG. 3 is an enlarged view of the portion of the production line where our fire retardant delivery system is installed. Feeding from an upper garnetting roller is a thin web of cotton 24 carried on an upper slide pan 48. Feeding from a lower garnetting roller is a second thin web of cotton 26 which is carried upwardly at an angle by a conveyor 50 which may form part of the lapper conveyor 28. As the upper batt 24 feeds from the slide pan 48 it is laid on top of the second web 26 travelling along conveyor 50. Prior to combining of webs 24 and 26, the webs may be as thin as 1/16 inch thick and approximately 60 inches wide.

Physically positioned between slide pan 48 and the conveyor 50 is shown, in section, upper air conduit 36 and a lower liquid conduit 38 each connected to a spray nozzle 40. A pipe nipple 52 is connected between the air conduit 36 and spray nozzle 40 and a pipe nipple 54 for conveying liquid spray retardant material is connected between liquid conduit 38 and spray nozzle 40. Spray nozzles 40 may preferably be of the type providing automatic shut-off when the air pressure is shut off which would prevent liquid fire retardant material in the manifold 38 from continuing to flow or "dribble" on to the lower web 26.

Figure 4:
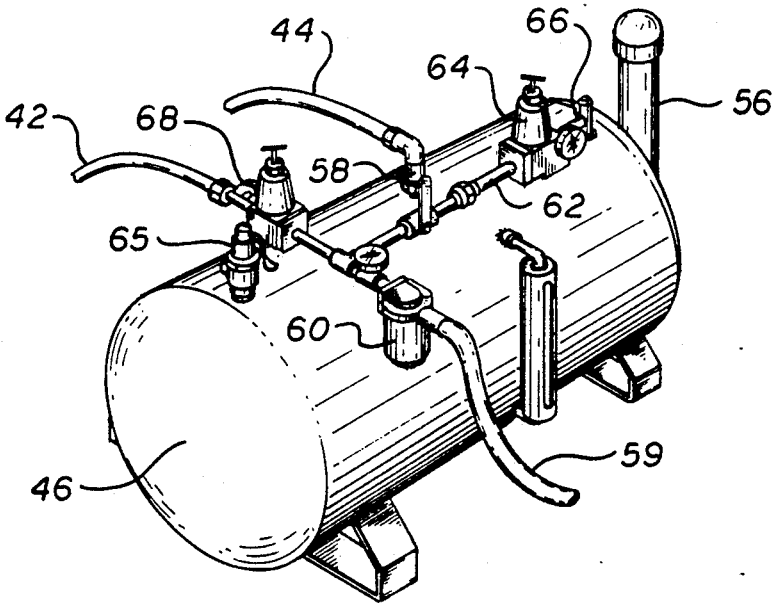
FIG. 4 is a perspective drawing of the tank employed in our fire retardant delivery system including conduits and regulators.

FIG. 4 is a perspective drawing of the tank employed in our fire retardant delivery system including specific arrangements of conduits and regulators. The tank 46 is connected to a source of air under pressure supplied through a hose 59 which air is filtered through filter 60 after which it is supplied through pipe 62 to a first regulator 64 which controls the pressure of air supplied to the tank. Liquid fire retardant material is placed in tank 46 through filler pipe 56 and is put under a positive air pressure to cause it to feed out of a check valve 58 to hose 44. Air from filter 60 is also supplied to a regulator 68 which controls the air pressure in conduit 36 supplied through hose 42. A pressure relief valve 65 and a manually operated bleed valve 66 are also installed on the tank 46.

It will be recognized that, as compared with the currently used system of supplying oil and boric acid powder to make the cotton batting material acceptably fire retardant, applicants' system has a number of advantages. A much smaller quantity of material is used. The liquid fire retardant material is biodegradable and nontoxic when used as described and when sprayed as described, lands on and is absorbed into the cotton fiber with little residue either in the air or on the floor. This contrasts with the boric acid powder which is present in the air and on the floor in quantities sufficient to require workers to wear masks when working near the point of application. The liquid fire retardant material is retained in the cotton fiber indefinitely and does not shake out after one or two years as does the boric acid powder. The quantities of liquid fire retardant used are such that treating a given amount of cotton is significantly less expensive than when using the described oil and boric acid process.

The fire retardant qualities remain effective irrespective of the thickness of the ultimate batts so long as the spray is applied to the thin webs as desired. Much thicker layers of cotton may be used for insulation than for furniture or mattresses and the fire retardant is essentially uniform throughout the material. Our system is also capable of applying the liquid fire retardant to other organic, cellulose-type material such as shredded paper so long as it can be fed in thin webs past the spray manifold as described.

The above described embodiment of the present invention is merely descriptive of its principles and is not to be considered limiting. The scope of the present invention instead shall be determined from the scope of the following claims including their equivalents.

What is claimed is:

1. A process for delivering liquid fire retardant material to webs in a cotton batt making machine including hopper means containing cotton, a garnett machine including two garnett rollers, conveyor means for conveying cotton to said hopper and from said hopper to said garnett machine, and a delivery system for combining the webs of cotton from each of said two garnett rollers;

a said process comprising the steps of:

a) providing a source of liquid fire retardant material under pressure and means regulating said pressure to a desired value;

b) providing a source of air under pressure and means regulating said pressure to a desired Value;

c) providing air and fluid manifolds and connecting each of a plurality of spray nozzles to each of said manifolds;

d) locating said manifolds and spray nozzles downstream of said garnett rollers such that said spray nozzles are positioned to direct a fine spray of fire retardant material and air between said webs of cotton just at and upstream of the point where said webs are combined; and e) connecting said air and liquid fire retardant sources to said manifolds.

2. A process for delivering liquid fire retardant material as claimed in claim 1 wherein a fine spray of oil is added to said cotton upstream of said garnett machine.

3. A process for delivering liquid fire retardant material as claimed in claim 1 wherein said source of liquid fire retardant material is a tank and said tank is connected to said source of air under pressure.

4. A process for delivering liquid fire retardant material as claimed in claim 1 including:

forming a pair of elongated webs of cotton and delivering the webs for engagement to join the webs together at an apex of a generally triangular cross section volume;

introducing the combined air and liquid into the triangular volume in spray form directed at the apex of the triangular volume.

5. A process in accordance with claim 1 wherein the pressure of said air and liquids are adjusted sufficient to atomize the liquid and spray it on and penetrate the thickness of the webs without disrupting the webs.

6. A process for delivering liquid fire retardant material to webs in a cotton batt making machine including hopper means containing cotton, a garnett machine including two garnett rollers for producing a pair of webs of cotton of thickness 1/16 to ½ inch, conveyor means for conveying cotton to said shopper and from said hopper to said garnett machine, and a delivery system for bringing the webs together while advancing them to produce a thicker web, the webs of cotton from each of said two garnett rollers;

said process comprising the steps of:

a) providing a source of liquid fire retardant material under pressure and means regulating said pressure to a desired value;

b) providing a source of air under pressure and means regulating said pressure to a desired value;

c) conveying air and liquid fire retardant into the region of the webs just before the webs are brought together; and d) directing a fine spray of fire retardant material an air between said webs of cotton just at and upstream of the point where said webs are combined with the fine spray directed into the webs as they are combined.

7. A process in accordance with claim 6 wherein the fine spray extends across the width of the webs to permeate substantially the entire width of both webs.

8. A process in accordance with claim 6 wherein the air pressure is adjusted to provide substantially full permeation of each web without disruption thereof.

9. A process in accordance with claim 8 wherein said air pressure is adjusted to on the order of 16 psig and the liquid pressure adjusted to on the order of 5 psig to produce impregnation of on the order of 1.4 gallons of fire retardant on 350 pounds of cotton batt material.

* * * * *

UNITED STATES PATENT AND TRADEMARK OFFICE

CERTIFICATE OF CORRECTION

PATENT NO. : 5,178,917

DATED : January 12, 1993

INVENTOR(S) : Diane Tenney & Michael Dosdourian

It is certified that error appears in the above-identified patent and that said Letters Patent is hereby corrected as shown below:

Column 2, line 22, after "complied" delete "o".

Column 4, line 51, change BOLD "60" to --60-- Non Bold.

Column 5, line 61, change "Value" to --value--.

Column 6, line 34, change "shopper" to --hopper--.

Column 6, line 48, change "an" to --and--.

Signed and Sealed this

Fourth Day of January, 1994

Bruce Lehman

*Attest:*

BRUCE LEHMAN

*Attesting Officer*

*Commissioner of Patents and Trademarks*